US008936750B2

(12) United States Patent
Fang et al.

(10) Patent No.: US 8,936,750 B2
(45) Date of Patent: Jan. 20, 2015

(54) FUNCTIONALLY GRADED CEMENTED TUNGSTEN CARBIDE WITH ENGINEERED HARD SURFACE AND THE METHOD FOR MAKING THE SAME

(75) Inventors: Zhigang Z. Fang, Salt Lake City, UT (US); Peng Fan, Salt Lake City, UT (US); Jun Guo, Salt Lake City, UT (US)

(73) Assignee: University of Utah Research Foundation, Salt Lake City, UT (US)

( * ) Notice: Subject to any disclaimer, the term of this patent is extended or adjusted under 35 U.S.C. 154(b) by 453 days.

(21) Appl. No.: 12/621,629

(22) Filed: Nov. 19, 2009

(65) Prior Publication Data

US 2011/0116963 A1 May 19, 2011

(51) Int. Cl.
*C22C 1/05* (2006.01)

(52) U.S. Cl.
USPC ..... 419/18; 79/240

(58) Field of Classification Search
USPC ..... 419/15, 18; 75/240
IPC ..... B22F 2999/00,2998/10, 2207/01, 3/1035; C22C 29/08
See application file for complete search history.

(56) References Cited

U.S. PATENT DOCUMENTS

| | | | | |
|---|---|---|---|---|
| 3,660,050 | A | 5/1972 | Iler et al. | |
| 4,610,931 | A | 9/1986 | Nemeth et al. | |
| 4,743,515 | A | 5/1988 | Fischer et al. | |
| 4,820,482 | A * | 4/1989 | Fischer et al. | 419/15 |
| 4,830,930 | A | 5/1989 | Taniguchi et al. | |
| 5,181,953 | A | 1/1993 | Nakano et al. | |
| 5,279,901 | A | 1/1994 | Akerman et al. | |
| 5,283,030 | A * | 2/1994 | Nakano et al. | 419/53 |
| 5,286,549 | A | 2/1994 | Hartzell et al. | |
| 5,401,461 | A | 3/1995 | Torbjorn et al. | |
| 5,413,869 | A | 5/1995 | Hartzell et al. | |
| 5,418,049 | A | 5/1995 | Drougge | |
| 5,453,241 | A | 9/1995 | Akerman et al. | |
| 5,541,006 | A | 7/1996 | Conley | |
| 5,549,980 | A | 8/1996 | Ostlund et al. | |
| RE35,538 | E | 6/1997 | Åkesson et al. | |
| 5,856,626 | A | 1/1999 | Fischer et al. | |
| 5,880,382 | A | 3/1999 | Fang et al. | |

(Continued)

FOREIGN PATENT DOCUMENTS

| | | |
|---|---|---|
| EP | 0500514 A1 | 8/1992 |
| JP | 02-221353 | 9/1990 |

(Continued)

OTHER PUBLICATIONS

U.S. Appl. No. 12/259,685; filed Oct. 28, 2008; Zhigang Zak Fang; office action issued Aug. 17, 2011.

(Continued)

*Primary Examiner* — Weiping Zhu
(74) *Attorney, Agent, or Firm* — Thorpe North & Western LLP

(57) ABSTRACT

A method of preparing a functionally graded cemented tungsten carbide material via heat treating a sintered cemented tungsten carbide is disclosed and described. The heat treating process comprises at least a step that heats the sintered material to the multi-phase non-equilibrium temperature range in which multiple phases including solid tungsten carbide, liquid metal binder, and solid metal binder coexist. Additionally, the material, after the heat treating process comprises a surface layer with lower metal binder content than the nominal value of metal binder content of the bulk of the material.

14 Claims, 2 Drawing Sheets

(56) References Cited

U.S. PATENT DOCUMENTS

| | | | |
|---|---|---|---|
| 6,063,502 | A | 5/2000 | Sue et al. |
| 6,214,079 | B1 | 4/2001 | Kear et al. |
| 6,638,474 | B2 | 10/2003 | Liu et al. |
| 6,641,918 | B1 | 11/2003 | Sherman et al. |
| 6,869,460 | B1 | 3/2005 | Bennett et al. |
| 7,157,148 | B2 | 1/2007 | Takai et al. |
| 2002/0194955 | A1 | 12/2002 | Fang et al. |
| 2005/0126335 | A1 | 6/2005 | Norgren et al. |
| 2005/0276717 | A1 | 12/2005 | Fang |
| 2006/0040104 | A1 | 2/2006 | Wort et al. |
| 2006/0266559 | A1 | 11/2006 | Keshavan et al. |
| 2007/0214913 | A1 | 9/2007 | Fang |
| 2008/0010905 | A1 | 1/2008 | Eyre |
| 2010/0101368 | A1 | 4/2010 | Fang et al. |

FOREIGN PATENT DOCUMENTS

| | | |
|---|---|---|
| JP | 03-115571 | 5/1991 |
| JP | 2004/183075 | 12/2005 |
| WO | WO 2010/062649 | 6/2010 |

OTHER PUBLICATIONS

American Society for Testing and Materials "Standard test Method for Apparent Porosity in Cemented Carbides", Annual Book of ASTM Standards, 1996.

Miyamoto et al. "Functionally Graded Materials: Design, Processing and Applications", Book, Kluwer Academic Publishers, 1999.

Put et al. "Functionally Graded WC-Co materials Produced by Electrophoretic Deposition", Scipta Materialia 45 (2001) 1139-1145.

Eso et al., University of Utah Department of Metallurgical Engineering; A New method for Making Functionally Graded WC-Co Composites via Liquid Phase Sintering; paper presented at PM Tec2 Conference in Chicago, Illinois, Jun. 2004.

Eso, Oladapo O., University of Utah Department of Metallurgical Engineering; Sintering Studies of Functionally Graded WC-Co Composites, handout distributed at PM Tec2 Conference in Chicago, Illinois, Jun. 2004.

Eso et al., University of Utah Department of Metallurgical Engineering; Liquid Phase Sintering of Functionally Graded WC-Co Composites; to appear in Int. J. Refractory Metals and Hard Materials, 2005.

U.S. Appl. No. 12/259,685; filed Oct. 28, 2008; Zhigang Zak Fang; office action issued Mar. 7, 2011.

U.S. Appl. No. 12/259,685; filed Oct. 28, 2008; Zhigang Zak Fang; Notice of Allowance issued Dec. 16, 2012.

Xiao Yi-feng, et al.; "Effects of carburizing process on gradient structure and hardness of WC-Co gradient cemented carbides"; The Chinese Journal of Nonferrous Metals,; vol. 18, No. 3, Mar. 31, 2008, pp. 465-470.

* cited by examiner

FUNCTIONALLY GRADED CEMENTED TUNGSTEN CARBIDE WITH ENGINEERED HARD SURFACE AND THE METHOD FOR MAKING THE SAME

BACKGROUND

This application relates to functionally graded cemented tungsten carbide materials that contain a metal binder gradient. The metal binder can be cobalt, nickel, iron or alloy thereof. Such materials may be used for metal cutting tools, rock drilling tools for oil exploration, mining, construction and road working tools and many other metal-working tools, metal-forming tools, metal-shaping tools, and other applications. For background information, the reader should consult U.S. Patent Application Publication No. 2005/0276717, which patent application is expressly incorporated herein by reference.

As explained in the prior patent publication noted above, it is desirable to construct a cemented tungsten carbide material ("WC" material) that includes an amount of metal binder. It is desirable to construct a cemented tungsten carbide material that has a combination of toughness and wear-resistance.

Cemented tungsten carbide, consisting of large volume fractions of WC particles in a metal binder matrix, is one of the most widely used industrial tool materials for metal machining, metal forming, mining, oil and gas drilling and all other applications. Compared with conventional cemented tungsten carbide, functionally graded cemented tungsten carbide (FGM cemented tungsten carbide) with a metal binder gradient spreading from the surface to the interior of a sintered piece offers a superior combination of mechanical properties. For example, FGM cemented tungsten carbide with a lower metal binder content in the surface region demonstrates better wear-resistance performance, resulting from the combination of a harder surface and a tougher core. Though the potential advantages of FGM cemented tungsten carbide are easily understood, manufacturing of FGM cemented tungsten carbide is however a difficult challenge. Cemented tungsten carbide is typically sintered via liquid phase sintering (LPS) process in vacuum. Unfortunately, when cemented tungsten carbide with an initial metal binder gradient is subjected to liquid phase sintering, migration of the liquid metal binder phase occurs and the gradient of metal binder is easily eliminated.

SUMMARY

Briefly, and in general terms, a method of preparing a functionally graded cemented tungsten carbide material is described. In one embodiment, the method can comprise obtaining sintered cemented tungsten carbide of tungsten carbide and a metal binder. The sintered material can be heat treated via a process comprising a step that heats the sintered material in a first temperature range of a multi-phase non-equilibrium state, in which temperature range at least solid tungsten carbide, liquid metal binder, and solid metal binder coexist. Additionally, the material, after the heat treating process, comprises a surface layer with lower content of metal binder than that of the nominal value of the metal binder content in the bulk of the material. Optionally, the heat treating process can be a two-step process which includes heating the sintered material in a carburizing atmosphere and at a temperature above the multi-phase non-equilibrium state so that liquid metal binder, but no solid metal binder, coexists with tungsten carbide and then heating in the temperature range of multi-phase-region. In still another optional embodiment, the heat treating process can be a three-step process which includes heating the sintered material subsequent to the multi-phase non-equilibrium state, in a decarburizing atmosphere and at a temperature below the multi-phase-region so that solid metal binder, but no liquid metal binder, coexists with tungsten carbide.

BRIEF DESCRIPTION OF THE DRAWINGS

Additional features and advantages of the invention will be apparent from the detailed description which follows, taken in conjunction with the accompanying drawings, which together illustrate, by way of example, features of the invention; and, wherein.

DETAILED DESCRIPTION

Figure 1:
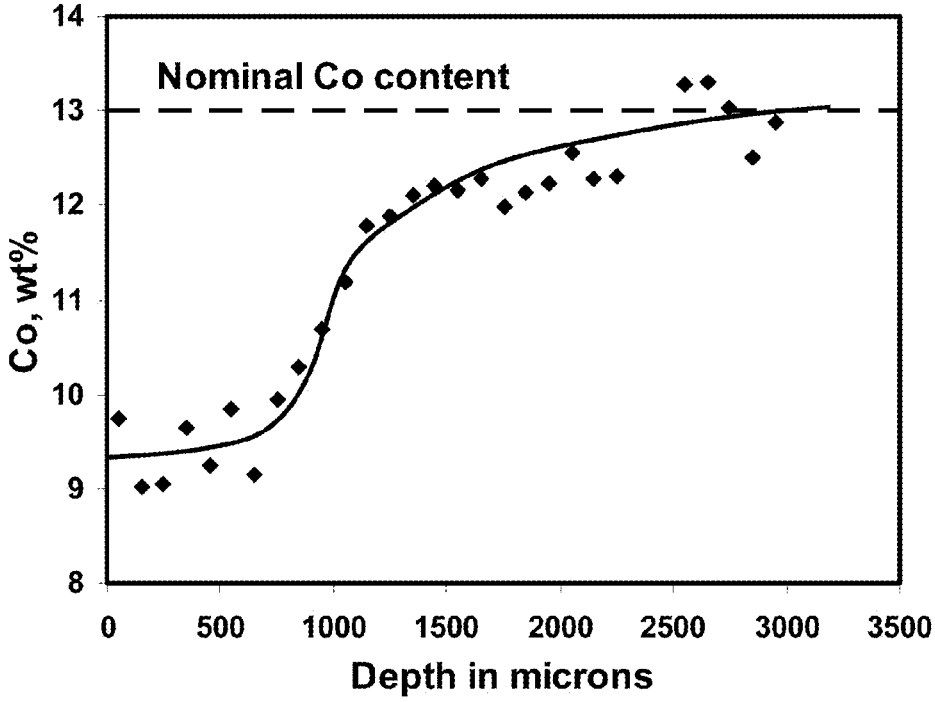
FIG. 1 is graph showing cobalt content in the surface region of a WC-Co sample, indicating the formation of a cobalt-depleted surface layer after a 3-step heat treatment

Before the present invention is disclosed and described, it is to be understood that this disclosure is not limited to the particular process steps and materials disclosed herein because such process steps and materials may vary somewhat. It is also to be understood that the terminology used herein is used for the purpose of describing particular embodiments only. The terms are not intended to be limiting because the scope of the present disclosure is intended to be limited only by the appended claims and equivalents thereof.

It must be noted that, as used in this specification and the appended claims, the singular forms "a," "an," and "the" include plural referents unless the context clearly dictates otherwise.

As used herein, "surface layer" refers to the thickness from the surface to the depth at which the metal binder content rises up to equal that of the nominal composition.

As used herein, "bulk of material" or "bulk of the material" refers to the portion of the material that is not the surface layer.

As used herein, "heat treating" normally refers to a single continuous heating process which may have one or more steps. Typically, the multi-step processes are part of a single heating run where the temperature is adjusted stepwise to obtain a new region and no cooling in between steps is required or even typically desirable.

As used herein, "nominal" refers to the average composition of the material regardless whether it is homogeneous or graded.

As used herein, when referring to a range, "within" includes the endpoints of the range. For example, a temperature within the multi-phase-region, would include the endpoints of the multi-phase-region; i.e., if the multi-phase-region was a temperature range between 1275° C. and 1325° C., the endpoints of 1275 and 1325 would be considered included in the recited range.

Functionally graded cemented tungsten carbide materials can be obtained from sintered cemented tungsten carbide materials using a uniquely designed heat treating process. The methods to obtain sintered cemented tungsten carbide materials generally include preparing a powder mixture of tungsten carbide and metal binder, and compacting the powder mixture together. In some embodiments, the powders can be compacted using known techniques, such as using uniaxial cold dies pressing methods although other compacting techniques can be suitable.

After compaction, the powder can then be sintered according to standard sintering procedures, e.g., at 1400° C. under a vacuum. As is known in the art, such sintering processes can produce a homogeneous cemented tungsten carbide material, with the amount of metal binder in the WC matrix being equal (homogenous or substantially homogenous) throughout the entire sample.

In the present embodiments, however, an additional process is performed to produce desired functionally graded (FGM) cemented tungsten carbide having improved properties. Specifically, this step is a "heat treating" process. The heat treating process itself includes at least one step of heat treatment in the temperature range of multi-phase-region, in which temperature range at least solid tungsten carbide, liquid metal binder, and solid metal binder coexist. Other solid additives such as carbides of other transition metals including VC, $Cr_2C_3$, NbC, TiC, TaC can also be present. The heat treating process can also include one or more additional steps in a temperature range above or below the multi-phase-region. Notably, it has been found that the 2-step and 3-step heat treatments provide more desirable results over even the 1-step heat treating process. The heat treating process as a whole, or its constituent steps, can be conducted either in the same sintering furnace run without removing the sample from the furnace, or in separate furnaces in separate thermal cycles. For example, if the sintering and heat treating are performed in a common furnace run, the heat treating process described herein becomes an extension of the sintering cycle. The desired FGM cemented tungsten carbide can have a harder and more wear-resistant surface layer and a tougher core compared to conventional cemented tungsten carbide.

The hard and wear-resistant surface layer can be comprised of the cemented tungsten carbide with graded metal binder content. The metal binder content at the surface can be significantly lower than that of the nominal composition of the bulk. The metal binder content usually increases as a function of the depth from the surface and can reach and even surpass the nominal composition of the composite at a certain depth. The metal binder content at the surface can be less than 95% of the nominal composition, and in some cases 30 to 90 percent of the nominal composition. The depth of the surface layer can be greater than 10 microns, such as from 50 to 5000 microns.

To manufacture the above described functionally graded cemented tungsten carbide product, the following method is described.

Sintered cemented tungsten carbide materials can be prepared according to standard manufacturing procedures as used in the industry. The sintered cemented tungsten carbide material can be prepared or obtained from a suitable commercial source. In one aspect, the metal binder can be cobalt, nickel, iron or their alloys. In another aspect, the sintered material can further include at least one of titanium, tantalum, chromium, molybdenum, niobium, vanadium, and carbides, nitrides and carbonitrides thereof. Most often these additives can be present in amounts less than about 20 wt %, although variations can be made for specific applications. These additives are often added for either grain size refinement or improvement of high temperature deformation and chemical wear resistance.

Sintered cemented tungsten carbide materials may have a carbon content of either sub-stoichiometry (or carbon deficient relative to stoichiometry), stoichiometry, or super-stoichiometry (or carbon excess relative to stoichiometry). In one aspect, the carbon content can be sub-stoichiometric. Stoichiometric carbon content of WC by its formula is 6.125% by weight. After metal binder is added, total carbon content will decrease proportionally depending on the metal binder content.

Prior to the heat treating process, a pre-treatment can optionally be applied where the sintered material is decarburized. The pre-treatment can be conducted in the same furnace run with the heat treating process or in separate furnace runs or separate furnace. Such a decarburizing step can be performed by subjecting the sintered material to a decarburizing atmosphere. For example, the atmosphere can be vacuum, hydrogen, nitrogen, or the like.

Another aspect regarding the carbon content of the material is that, prior to the heat treating process, the carbon content of the material can be high enough such that there are no complex carbides in the material. The complex carbides, that have lower carbon contents than that of tungsten carbide, are undesired brittle carbides of tungsten and metal binder, which form when the total carbon content is excessively low. When the metal binder is cobalt, the complex carbide is η-phase with a typical formula of $Co_3W_3C$.

If there are above-mentioned complex carbides in the sintered material, a carburizing pre-treatment may be applied to remove the complex carbides, prior to the heat treating process. The pre-treatment may be conducted in the same furnace run with the heat treating process or in a separate furnace run. Such a carburizing step can be performed by subjecting the sintered material to a carburizing atmosphere. For example, the atmosphere can include carbon dioxide, carbon monoxide, methane, and the like, and may include optional carrier gases such as nitrogen, oxygen, or the like.

Another aspect of the invention is that the heat treatment can include a multi-phase-region treatment step, carried out within a multi-phase-region temperature range, in which temperature range at least solid tungsten carbide, liquid metal binder, and solid metal binder coexist. This step is referred to as a multi-phase-region step herein. This step can influence whether a significant metal binder gradient can be obtained in the case where substantially no complex carbide exists in the material. In one aspect, for straight WC-Co (i.e., the binder is cobalt and there is no other additives), the multi-phase-region temperature range is 1275° C. to 1325° C. When carbides of other transitional elements such as V, Cr, Ta, Ti, and Mo, are added, the temperature the multi-phase-region temperature range will vary depending on exact content. When the metal binder of cobalt is substituted by nickel, iron or alloy, the temperature the multi-phase-region temperature range will be changed as well. If the heat treating process includes only this step, this step can be carried out in a carburizing atmosphere, and is referred to as a one-step heat treatment. Regardless, the sintered material can be free of complex carbides during any step of the heat treatment.

Another aspect of the invention is that the heat treating process can also include other one or two steps in the temperature range outside the multi-phase-region, so that the heat treatment becomes 2-step or 3-step heat treatment. The step above the multi-phase-region is referred to as liquid-binder-region step, since liquid metal binder, but no solid metal binder, coexists with WC in this step; while the treatment step below the multi-phase-region is referred to as solid-binder-region step, since solid metal binder, but no liquid metal binder, coexists with WC in this step. The specific temperature limits for these respective regions will vary with the choice of materials and relative proportions.

Another aspect of the invention is that the 2-step heat treatment can include a liquid-binder-region step followed by a multi-phase-region step. The first step can be carried out in a carburizing atmosphere. The second step can be carried out in either a) a vacuum, b) an inert gas, c) a non-carburizing and non-decarburizing atmosphere, d) a decarburizing atmosphere, or e) a carburizing atmosphere. In one aspect, the second step is carried out under a carburizing atmosphere.

In another aspect, the multi-step heat treating process can comprise a third step in solid-binder-region. In one aspect, the 3-step heat treatment can include a liquid-binder-region step, then a multi-phase-region step, followed by a solid-binder-region step. The first step can be carried out in a carburizing atmosphere. The second step can be carried out in either a) a vacuum, b) an inert gas, c) a non-carburizing and non-decarburizing atmosphere, d) a decarburizing atmosphere, or e) a carburizing atmosphere. In one aspect, the second step can be carried out in a carburizing atmosphere. The third step can be carried out in either a) a non-carburizing atmosphere including vacuum, neutral and inert or b) a decarburizing atmosphere. In one aspect, the third step can be carried out under a decarburizing atmosphere.

Optionally, the heat treating is a two step process which includes a first step of heat treating by the multi-phase-region step followed by the second step of heat treating by the solid-binder-region step. For example, heating the sintered material within a temperature range which is below the multi-phase region temperature such that solid metal binder, but no liquid metal binder, coexists with solid tungsten carbide, after heating the sintered material to the multi-phase non-equilibrium state but without heating to form all liquid binder.

Oversaturation of carbon can result in free carbon at the surface of the material. Depending on the intended application, such free carbon may not be commercially acceptable. Therefore, an optional decarburizing step can be performed if free carbon is not desired. This can be removed by any suitable process and in one example can include maintaining the material in a heated state but which is at a temperature region of all solid. A vacuum or decarburizing atmosphere can be applied such that carbon diffuses into the material and/or is removed from the surface.

A method of preparing a functionally graded cemented tungsten carbide material can comprise obtaining sintered cemented tungsten carbide of tungsten carbide, a metal binder and optional additives and heat treating the sintered material via a one- or multi-step heat treating process. As described herein, the heat treating process include at least a step that heats the sintered material in the temperature range of multi-phase-region, in which temperature range at least solid tungsten carbide, liquid metal binder, and solid metal binder coexist. Additionally, the material, after the heat treating step, comprises a surface layer with lower content of metal binder than that of the nominal value of the metal binder content in the bulk of the material.

In one embodiment, a functionally graded cemented tungsten carbide material can be manufactured by any of the heat treating processes described herein. In one aspect, the functionally graded cemented tungsten carbide material can be manufactured by a 1-step heat treating process. In another aspect, the functionally graded cemented tungsten carbide material can be manufactured by a 2-step heat treating process. In still another aspect, the functionally graded cemented tungsten carbide material can be manufactured by a 3-step heat treating process.

As discussed herein, the present materials can have superior properties compared to materials not formed by the present methods. In one aspect, the functionally graded cemented tungsten carbide can comprise a hard surface layer and a tough core, in which the hardness of the surface is higher than that of the center of the interior by at least 30 Vickers hardness number using standard Vickers hardness testing method under 1 to 50 kilogram load. Furthermore, in some cases, the functionally graded cemented tungsten carbide can be substantially free of graphite (i.e. free carbon), and in many cases completely free of graphite. In other alternative, free-carbon can be left in the microstructure in order to reach deeper into the material. Also, using the methods described herein, the functionally graded cemented tungsten carbide material can have an interior (deeper than the surface layer gradient) metal binder content which is near nominal (e.g. within 5-10% of nominal). Herein, "nominal" refers to the average bulk content (i.e. total binder per total material).

Another aspect is that the heat treatment can be carried out at a pressure ranging from near-vacuum to above the atmospheric pressure, preferably between 10 torr and 100 MPa.

Yet another aspect is that the heat treating process can be carried out as an added step to the standard sintering cycle without removing the specimens from the furnace. In other words, the desired FGM cemented tungsten carbide material can be produced in one thermal cycle from powder. This is possible because of the kinetic rate of the binder metal gradient formation is sufficiently fast. A separate treatment procedure may also be used if so desired due to other non-technical reasons.

Generally, a metal binder gradient is considered to be formed in the multi-phase-region step in heat treatment. Although all details of this mechanism are not fully understood and without being bound to the following observations, it appears that the mechanism of metal binder gradient formation is based on the following two principles:

1) Volume fraction of liquid binder phase in a multi-phase-region, where liquid-binder/solid-binder/WC coexists, depends on the carbon content; and
2) Liquid binder phase migrates from a region with more liquid binder phase towards a region with less liquid binder phase within the sintered material if other conditions are the same.

Figure 2:
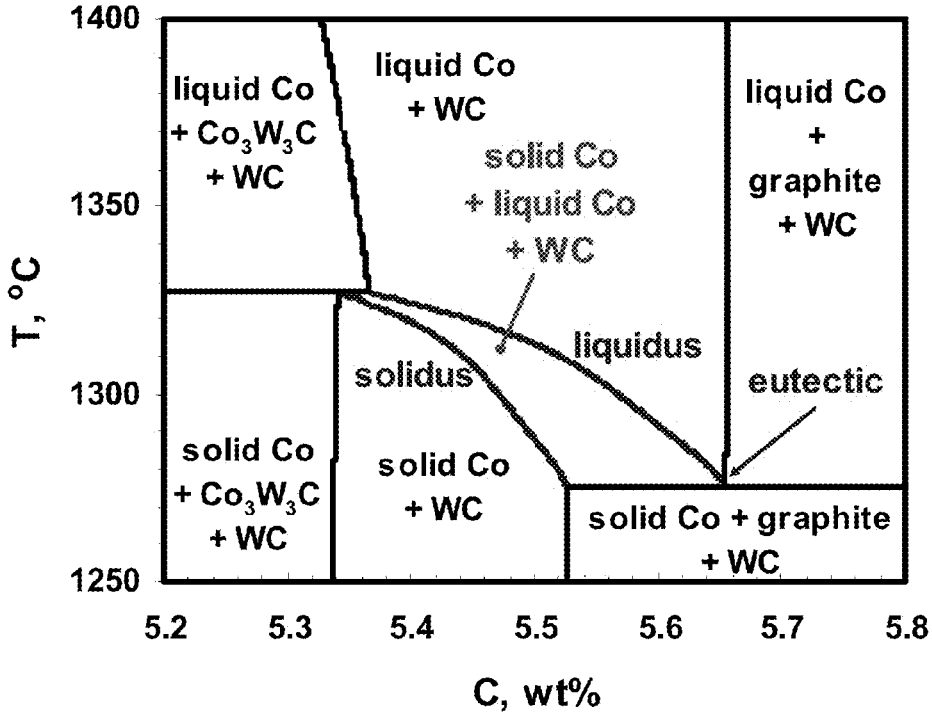
FIG. 2 is a vertical section of a ternary phase diagram of W-Co-C system with 10 wt % Co

The ternary phase diagram of W-Co-C system, as shown in FIG. 2, illustrates the mechanism. A multi-phase-region (in this case a 3-phase-region), in which WC, liquid metal binder (in this case cobalt), and solid metal binder (in this case cobalt) co-exist in the temperature range of about 1275° C. to about 1325° C., is located in the central region of the diagram. Within this multi-phase-region, the amount of liquid Co phase increases dramatically with increasing carbon content at the expense of the decrease of solid Co phase under carburizing conditions. Carbon diffuses into the material at the surface resulting in a higher proportion of liquid binder at the surface. The solid Co phase will transform to liquid Co according to the phase diagram upon carburization in this temperature range. At the left boundary of the solid-Co/liquid-Co/WC multi-phase-region (i.e., solidus line), the volume fraction of solid Co phase is high and there is no liquid Co phase; whereas at the right boundary of the multi-phase-region (i.e., liquidus line), the volume fraction of solid Co phase approaches zero and the volume fraction of liquid Co phase is maximum. The relative fraction of liquid binder and solid binder is influenced by the resulting carbon gradient through the material. The carbon gradient provides an "inducing force" for migration of liquid binder away from the surface such that binder content near the surface decreases. By cooling during this condition, this binder gradient can be preserved in a final product.

Without intending to be bound by any particular theory, the following observations regarding the mechanism of a Co gradient in the multi-phase-region step of heat treatment can be summarized as follows:

Surface carburization=>

Solid Co in surface region partially or totally transforms to liquid=>

Liquid Co in surface region increase=>

Balance of liquid Co distribution between surface and core regions breaks=>

Liquid Co migrates from surface region to core region=>

Co gradient forms.

Given the above mechanism, the general expected process is as follows. For example, for a WC-10 wt % Co specimen with a stoichiometric C content (5.53 wt % C), to be carburized at 1300° C., the C and Co contents are uniform throughout the specimen before carburization begins. Thus, the volume fraction of liquid Co phase in the surface region is equal to that in the core region. In other words, the distribution of liquid Co phase within the specimen is balanced between the surface and the core. During the carburization process, the C content in the surface region increases, leading to the increase of the volume fraction of liquid Co phase in the surface region. The higher volume fraction of liquid Co phase in the surface region breaks the balance of the distribution of liquid Co phase between the surface region and the core region, giving rise to the migration of the liquid Co phase from the surface region towards the core region and thus resulting in the formation of Co gradient with reduced Co content in the surface region.

It can be noted, however, the above descriptions of the metal binder migration addresses the thermodynamic direction of the change. The final gradient in a product also depends on the control of the kinetics of the processes including carbon diffusion and liquid migration.

The experiments using 1-step heat treating process showed that the thickness of obtained Co gradients is usually less than 200 μm. This limited thickness of Co gradient is attributed to the limited depth of carbon diffusion into the product by 1-step heat treatment. In the 1-step heat treatment, the carbon diffusion process and the cobalt gradient formation process are coupled with each other. In other words, Co gradient frontier matches along with the carbon diffusion frontier. As carbon diffusion proceeds, the volume fraction of liquid Co content near the surface layer decreases which in turn dramatically reduces the diffusion flux of carbon and the advance of graded layer. Thus, the heat treatment can involve diffusion, phase transformation and liquid migration and other unit processes.

However, for many applications, especially for rock drilling, thicker gradients may be needed for significant gains in performance. Therefore, a 2-step heat treatment is devised to make thicker gradients, via decoupling the carbon diffusion and cobalt gradient formation so as to overcome the limitation of carbon diffusion depth in 1-step heat treatment.

In one aspect, the first step can be a liquid-binder-region step, of the 2-step heat treatment and can be carried out in a carburizing atmosphere at a temperature above the temperature range of multi-phase-region. At this temperature, all metal binder exists in liquid state, so carbon content increase in the surface region will not significantly increase the amount of liquid metal binder phase and drive liquid metal binder to migrate inwards resulting in the decrease of metal binder content at the surface. Thus, the depth of carbon diffusion in this step can be very large.

In one aspect, the second step can be a multi-phase-region step, of the 2-step heat treatment. As soon as the temperature is lowered down to the multi-phase-region temperature range, part of the liquid metal binder in both the surface region and the core region will transform to solid. More liquid metal binder will be in the surface region because the surface region has higher carbon content. This breaks the balance of liquid metal binder distribution between the surface region and the core region, causing the migration of liquid metal binder from the surface towards the core, thus forming a metal binder gradient between the surface and the core. In this way, the final depth of metal binder gradient is equal to the very large depth of carbon diffusion obtained in the first step.

The experiments using 2-step heat treatment showed that the thickness of obtained metal binder gradients is usually less than 600 μm. Further increase in gradients' thickness often results in the occurrence of a surface layer with free graphite, which limits the thickness of gradient layer without free graphite to be 200 to 500 μm.

In order to further increase the thickness of gradient without free graphite, a 3-step heat treatment is devised, via adding a third step to the 2-step heat treating process to remove free graphite.

The third step can be a solid-binder-region step in the 3-step heat treatment, which can be carried out at a temperature below the temperature range of multi-phase-region. At this temperature, all binder exists in solid state. After holding the sintered material in a decarburizing atmosphere for a sufficient period of time, the free graphite is found to disappear. Since there is no liquid metal binder at this step, the metal binder gradient formed before this step is found to be preserved. Therefore, very thick Co gradients without free graphite can be made using 3-step heat treating process. In one aspect, the resultant thickness can be over 2000 μm. In fact, there is no limit to the maximum thickness of the gradient. Depending on the application of the material and the actual dimension of a component, thickness of the gradient may vary from 50 to 5000 microns or even greater.

It is worth pointing out that the mechanism of the well-known DP carbide process to make similar FGM WC-Co with cobalt-depleted surface is different from this invention. In DP carbide process, η phase existed before and after carbonization heat treatment in the core region, while the η phase in the surface region was totally consumed by the carbonization reaction $$CH_4(g) + \frac{1}{2}Co_3W_3C(s) = 2\ H_2(g) + \frac{3}{2}WC(s) + \frac{3}{2}Co(l) \qquad \text{Equation (1)}$$

The release of liquid Co at surface region via the above reaction drives the liquid Co to migrate inwards and results in a Co-depleted surface.

For the samples used in the present process, no η phase existed before and after heat treatment, indicating a different mechanism of forming Co gradient in this process as discussed in the previous part.

The following examples illustrate a number of embodiments of the present compositions, systems, and methods that are presently known. However, it is to be understood that the following are only exemplary or illustrative of the application of the principles of the present compositions, systems, and methods. Numerous modifications and alternative compositions, methods, and systems may be devised by those skilled in the art without departing from the spirit and scope of the present systems and methods. The appended claims are intended to cover such modifications and arrangements. Thus, while the present compositions, systems, and methods have been described above with particularity, the following examples provide further detail in connection with what are presently deemed to be the acceptable embodiments.

EXAMPLES

Example 1

WC-Co via 1-Step Heat Treatment

The conventionally liquid-phase-sintered homogenous WC-Co was used for 1-step heat treatment test. The nominal Co content was 13 wt %. The C content was sub-stoichiometric.

The multi-phase-region step of the 1-step heat treatment was conducted in a carburizing atmosphere of mixed methane ($CH_4$) and hydrogen ($H_2$), holding at 1300° C. for 3 hours. The $(P_{H2})^2/P_{CH4}$ in the gas mixture was 50 and the total pressure was 1 bar.

After treatment, the cross-sections of specimen was polished and etched with Murakami's reagent for 10 s to determine if there were any $Co_3W_3C$ ($_\eta$) phase or free graphite present. Cobalt concentration profile perpendicular to the surface was measured using the Energy Dispersive Spectroscopy (EDS) technique. Each data point of the cobalt content is an averaged value obtained by scanning a 10 μm by 140 μm rectangular area on the polished surface. The standard variation of the data is less than 10% of the measured cobalt content.

Figure 3:
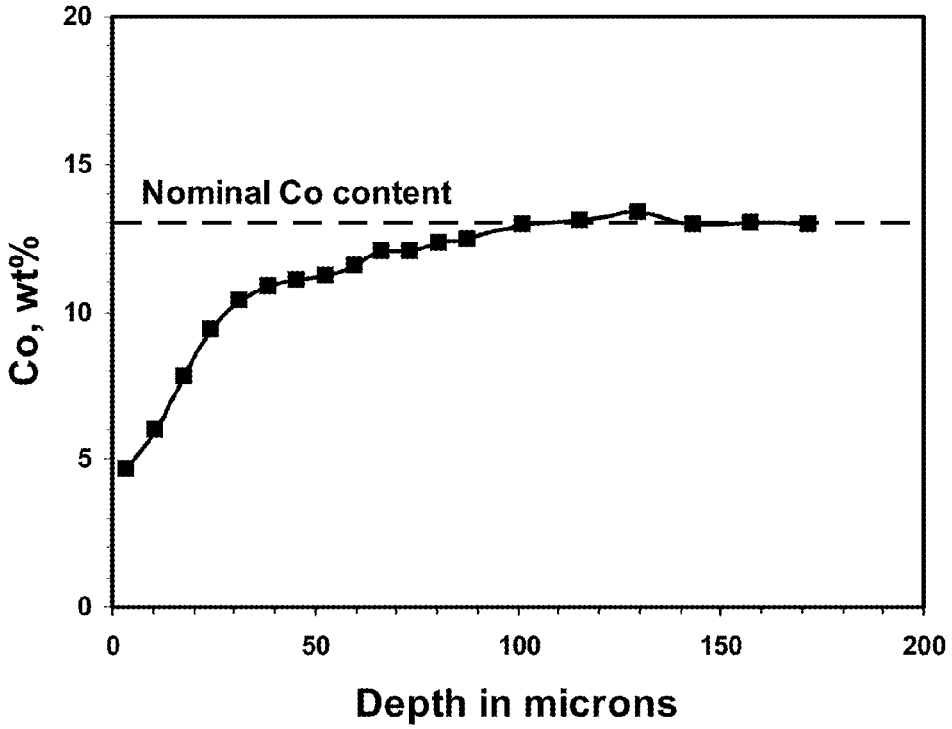
FIG. 3 is graph showing cobalt content in the surface region of a WC-Co sample, indicating the formation of a cobalt-depleted surface layer after a 1-step heat treatment

The obtained Co content profile, as shown in FIG. 3, demonstrated that a Co gradient with reduced Co content at surface formed. The thickness of the gradient was around 120 μm.

Example 2

WC-Co via a 2-Step Heat Treatment

The same material as in Example 1 was used for 2-step heat treatment test.

The first step of a 2-step heat treatment was a liquid-Co-region step and was conducted in a carburizing atmosphere of mixed methane ($CH_4$) and hydrogen ($H_2$), holding at 1370° C. for 0.5 hours. The $(P_{H2})^2/P_{CH4}$ in the gas mixture was 900 and the total pressure was 1 bar.

The second step was a 3-phase-region step and was conducted in a carburizing atmosphere of mixed methane ($CH_4$) and hydrogen ($H_2$), holding at 1300° C. for 1 hours. The $(P_{H2})^2/P_{CH4}$ in the gas mixture was 50 and the total pressure was 1 bar.

Figure 4:
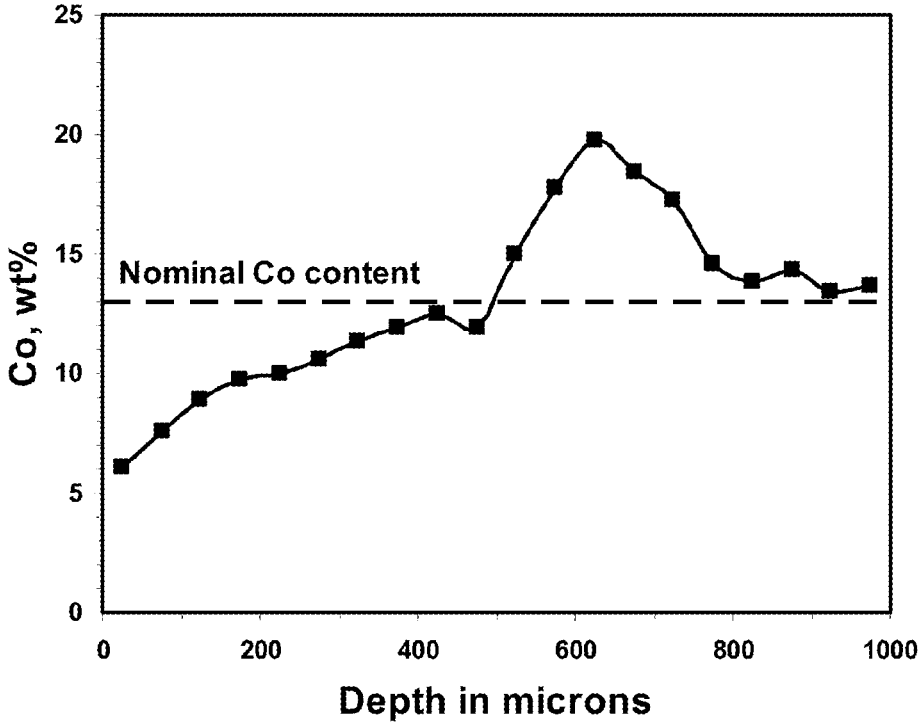
FIG. 4 is graph showing cobalt content in the surface region of a WC-Co sample, indicating the formation of a cobalt-depleted surface layer after a 2-step heat treatment Reference will now be made to the exemplary embodiments illustrated, and specific language will be used herein to describe the same. It will nevertheless be understood that no limitation of the scope of the invention is thereby intended.

The analysis method was the same as in Example 1. The obtained Co content profile, as shown in FIG. 4, demonstrated that a thicker Co gradient with reduced Co content at surface formed. The thickness of the gradient was around 500 μm. As such, the present data shows that the 2-step heat treatment provided unexpected results over the 1-step heat treatment.

Example 3

WC-Co via a 3-Step Heat Treatment

The same material as in Example 1 was used for 3-step heat treatment test.

The first step was a liquid-Co-region step and was conducted in a carburizing atmosphere of mixed methane ($CH_4$) and hydrogen ($H_2$), holding at 1370° C. for 25 minutes. The $(P_{H2})^2/P_{CH4}$ in the gas mixture was 50 and the total pressure was 1 bar.

The second step was a 3-phase-region step and was conducted in a carburizing atmosphere of mixed methane ($CH_4$) and hydrogen ($H_2$), holding at 1290° C. for 1 hour. The $(P_{H2})^2/P_{CH4}$ in the gas mixture was 50 and the total pressure was 1 bar.

The third step was a solid-Co-region step and was conducted in a de-carburizing atmosphere of mixed methane ($CH_4$) and hydrogen ($H_2$), holding at 1230° C. for 12 hour. The $(P_{H2})^2/P_{CH4}$ in the gas mixture was 1300 and the total pressure was 1 bar.

The analysis method was the same as in Example 1.

The obtained Co content profile, as shown in FIG. 1, demonstrated that a thicker Co gradient with reduced Co content at surface formed. The thickness of the gradient was around 2500 μm. There is no free graphite in the treated material. As such, the present data shows that the 3-step heat treatment provided unexpected results over the 1-step heat treatment.

While the disclosure has been described with reference to certain preferred embodiments, those skilled in the art will appreciate that various modifications, changes, omissions, and substitutions can be made without departing from the spirit of the disclosure. It is intended, therefore, that the invention be limited only by the scope of the following claims.

What is claimed is:

1. A method of preparing a functionally graded cemented tungsten carbide material, the method comprising:

obtaining a sintered cemented tungsten carbide material including tungsten carbide and a metal binder, the sintered material being homogeneous and substantially free of complex carbides and η phases prior to subsequent heat treating, and having an initial nominal value of the metal binder;

heat treating the sintered material via a controlled diffusion process that includes:

forming a carbon gradient by heating the sintered material to a liquid binder region within a liquid binder temperature range in which liquid metal binder, but no solid metal binder, coexists with tungsten carbide, said heating being maintained for a first holding time to form a carbon gradient having a depth of diffusion; and subsequently forming a metal binder gradient by step-wise heating the sintered material to a multi-phase non-equilibrium state within a multi-phase temperature range in which liquid and solid binder phases coexist and wherein the multi-phase non-equilibrium state includes solid tungsten carbide, liquid metal binder, and solid metal binder, said step-wise heating being maintained for a second holding time sufficient to allow migration of liquid metal binder across the depth of diffusion to form the metal binder gradient; and cooling the sintered material at a predetermined time to preserve the functionally graded cemented tungsten carbide having a surface layer with lower content of the metal binder than that of a final nominal value of the metal binder in a bulk of the functionally graded cemented tungsten carbide.

2. A method as in claim 1, wherein the obtaining the sintered material includes:

preparing a powder mixture comprising tungsten carbide powder and metal binder powder;

compacting the powder mixture; and sintering the compacted powder mixture.

3. A method as in claim 1, further comprising pretreating prior to said heat treating, wherein the said sintered material is decarburized or carburized.

4. A method as in claim 1, wherein the sintered material contains sub-stoichiometric carbon content.

5. A method as in claim 1, wherein the sintered material contains stoichiometric carbon content.

6. A method as in claim 1, wherein the sintered material contains super-stoichiometric carbon content.

7. A method as in claim 1, wherein the metal binder is cobalt, nickel, iron, or alloy thereof.

8. A method as in claim 1, wherein the heat treating is a three step process which further comprises heating the sintered material to a solid binder region within a solid binder temperature range in which solid metal binder, but no liquid metal binder, coexists with solid tungsten carbide, wherein the solid binder region is performed after the multi-phase non-equilibrium state, wherein the heating the sintered material to a solid binder region is maintained for a time sufficient to remove free graphite.

9. A method as in claim 1, wherein the heat treating is conducted in the same furnace without removing the material from the furnace during the heat treating.

10. A method as in claim 1, wherein the sintered cemented tungsten carbide further includes at least one of titanium, tantalum, chromium, molybdenum, niobium, vanadium, carbides thereof, nitrides thereof, and carbonitrides thereof.

11. A method as in claim 1, wherein the functionally graded cemented tungsten carbide is free of graphite.

12. A method as in claim 1, wherein the functionally graded cemented tungsten carbide is free of $\eta$ phase or other complex carbide of tungsten and transition metal binder.

13. A method as in claim 1, wherein said depth of diffusion extends only through a surface region separate from a core region.

14. A method as in claim 13, wherein the final nominal value of the metal binder in the core region is substantially the same as the initial nominal value.

* * * * *